US006743052B1

(12) United States Patent
Lin et al.

(10) Patent No.: US 6,743,052 B1
(45) Date of Patent: Jun. 1, 2004

(54) ELECTRICAL ADAPTER HAVING NOISE ABSORBER

(75) Inventors: Hsien-Chu Lin, Tu-Chen (TW); Shu-Chen Yang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/387,650

(22) Filed: Mar. 12, 2003

(30) Foreign Application Priority Data

Dec. 25, 2002 (TW) ..... 91221053 U

(51) Int. Cl.[7] ..... H01R 13/66
(52) U.S. Cl. ..... 439/620; 439/638
(58) Field of Search ..... 439/620, 638, 439/607, 610

(56) References Cited

U.S. PATENT DOCUMENTS 4,885,559 A 12/1989 Nakano
5,334,955 A 8/1994 Strnad
6,343,957 B1 2/2002 Kuo
6,439,916 B1 8/2002 Kuo
6,461,184 B2 * 10/2002 Nimura ..... 439/352
6,554,650 B2 * 4/2003 Kayworth et al. ..... 439/638

* cited by examiner

*Primary Examiner*—Gary Paumen
*Assistant Examiner*—James R. Harvey
(74) *Attorney, Agent, or Firm*—Wei Te Chung

(57) ABSTRACT

An electrical adapter (1) includes a first electrical connector (2) having a first insulative housing (23) with a number of first terminals (24) received therein, a second electrical connector (4) having a second insulative housing (43) with a number of second terminals (44) received therein, a connecting portion (3) electrically connecting the first and the second electrical connectors, and a noise absorber (5) surrounding the connecting portion.

7 Claims, 4 Drawing Sheets

ELECTRICAL ADAPTER HAVING NOISE ABSORBER

BACKGROUND OF THE INVENTION

1. Field of the Invention

The present invention is related to an electrical adapter, and particularly to an electrical adapter having a noise absorber for electrically interconnecting two electrical connectors.

2. Description of Related Art

An electrical adapter is widely used in computer industry for interconnecting two electrical connectors or other electronic components of different types. U.S. Pat. Nos. 6,343,957 and 6,439,916 each disclose a typical electrical adapter. Each adapter comprises a first connector which is adapted for mating with a complementary connector of a cable assembly connected with a monitor, and a second connector mounted in a host computer, thereby electrically connecting the monitor and the host computer. The adapter further comprises metallic shells on opposite ends thereof to prevent the connectors from Electro-Magnetic Interference. However, there is no noise absorber to filter the electromagnetic noise accompanying a transmitted signal.

U.S. Pat. Nos. 4,885,559 and 5,334,955 each disclose a signal filter having a magnetic ferrite component attached to a cable for absorbing the electromagnetic noise. However, since there is a distance between the filter and a related connector connected with the cable, the electromagnetic noise generated on portions of conductors of the connector and the cable located between the filter and the connector can not be effectively absorbed, thereby adversely affecting the quality of signals transmitted into or from a related electrical device connected with the connector.

Hence, it is requisite to provide an improved electrical adapter to overcome the aforementioned disadvantage in the related art.

SUMMARY OF THE INVENTION

Accordingly, an object of the present invention is to provide an electrical adapter having a noise absorber to improve the quality of the signal transmitted between related electrical devices.

Another object of the present invention is to provide an electrical adapter having a noise absorber positioned at a critical location to absorb the electromagnetic noise effectively.

In order to achieve the objects set forth, an electrical adapter in accordance with the present invention comprises a first electrical connector, a second electrical connector, a connecting portion and a noise absorber. Each of the first and the second electrical connectors comprises an insulative housing and a plurality of terminals received therein. The connecting portion electrically connects the two electrical connectors and the noise absorber surrounds the connecting portion for absorbing the electromagnetic noise more effectively.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
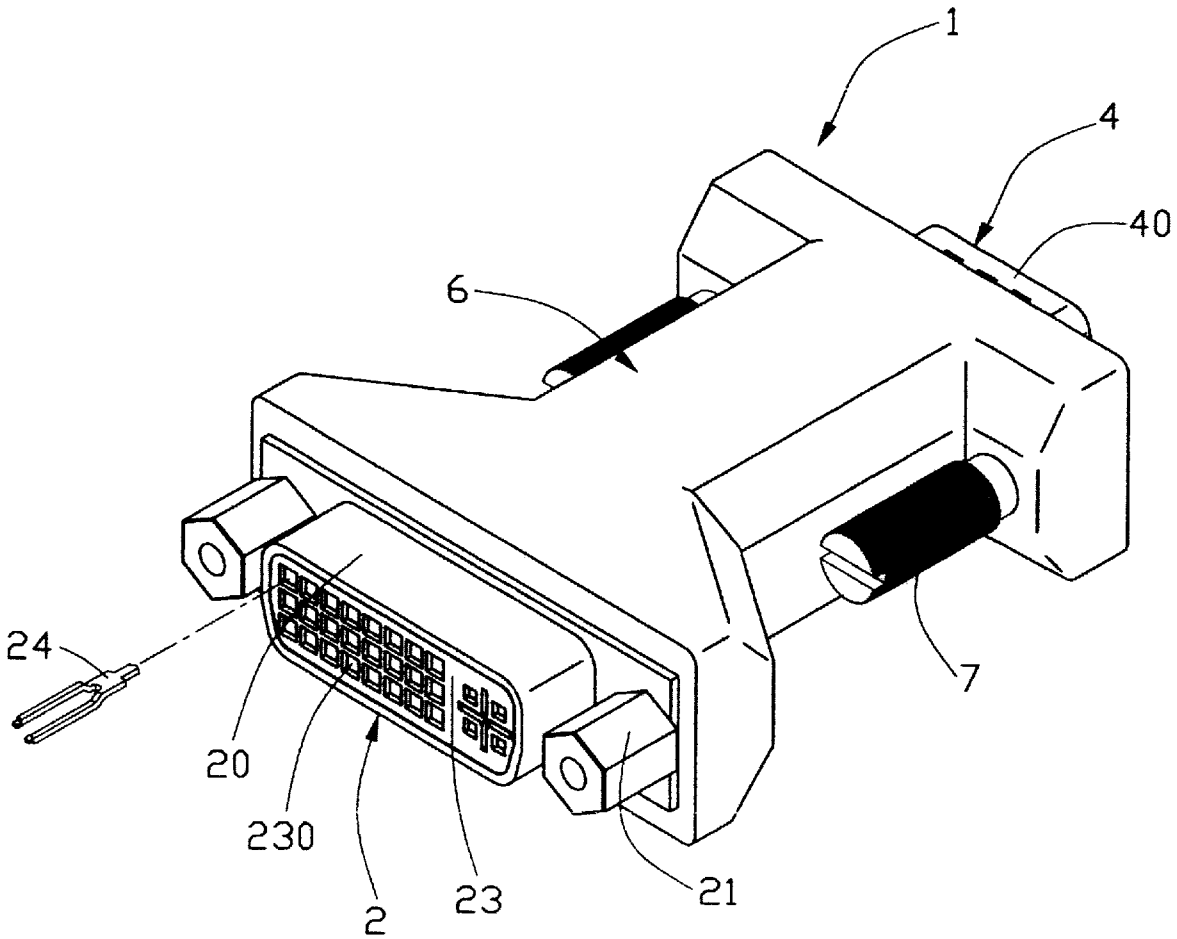
FIG. 1 is an assembled perspective view of an electrical adapter in accordance with the present invention.
Figure 3:
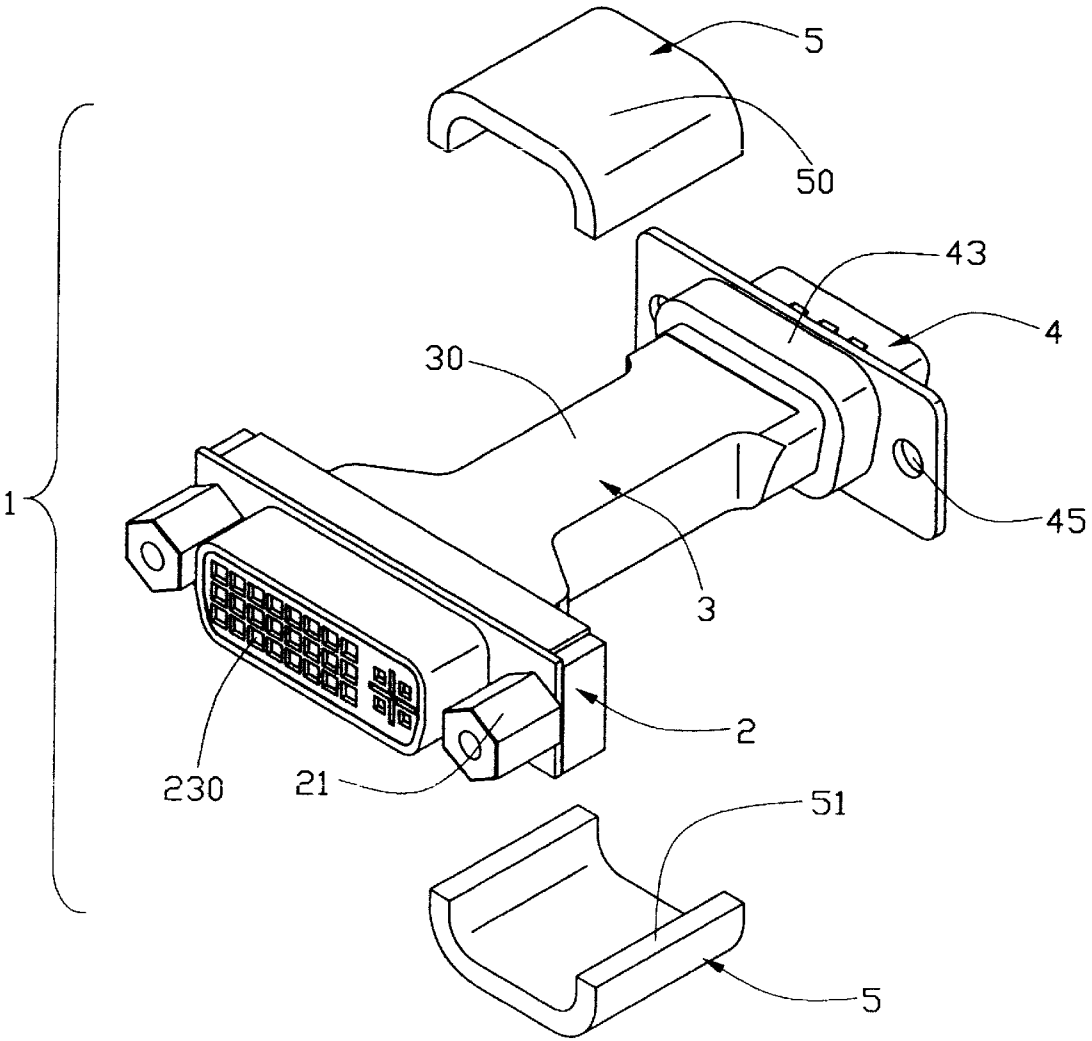
FIG. 3 is a partially exploded perspective view of the electrical adapter of FIG. 1, but with a cover and a pair of bolts thereof removed.

Referring to FIGS. 1 and 3, an electrical adapter 1 in accordance with the present invention comprises a first electrical connector 2, a connecting portion 3, a second electrical connector 4, a noise absorber 5 and a cover 6.

Figure 2:
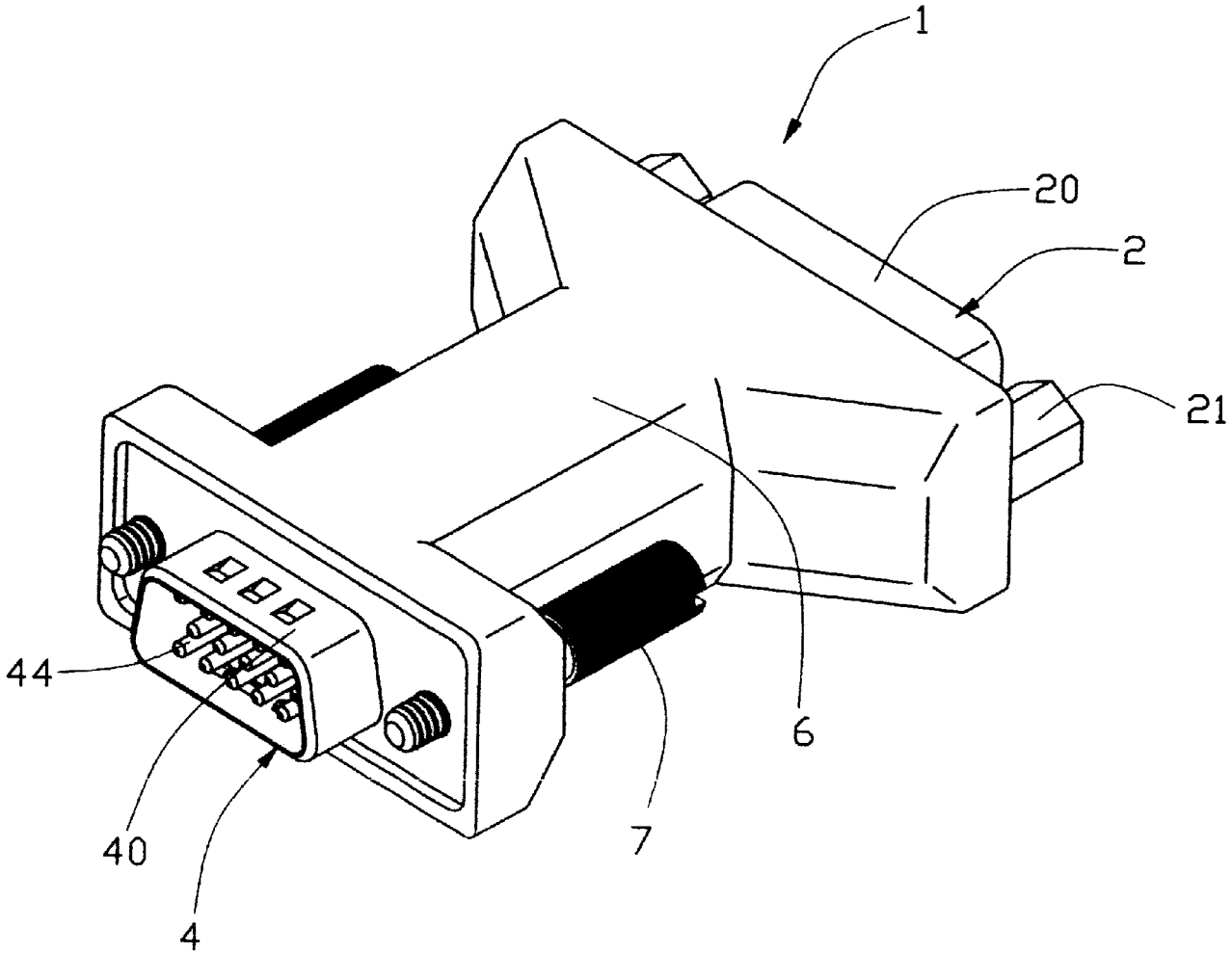
FIG. 2 is an assembled perspective view of the electrical adapter of FIG. 1 viewed from a different aspect.

The first electrical connector 2 comprises a first insulative housing 23 defining a plurality of passageways 230, a first metallic shell 20 attached to the housing 23, a plurality of first terminals 24 received in the passageways 230, and a pair of fasteners 21 assembling the first metallic shell 20 to the housing 23. Also referring to FIG. 2, the second electrical connector 4 comprises a second insulative housing 43 defining a plurality of passageways (not shown) and a pair of through holes 45 on opposite ends thereof, a second metallic shell 40 attached to the housing 43, a plurality of second terminals 44 received in the passageways of the second housing 43, and a pair of bolts 7 received in the through holes 45 of the second housing 43.

The first electrical connector 2 and the second electrical connector 4 are electrically connected by the connecting portion 3. The first terminals 24 of the first electrical connector 2 connect with the second terminals 44 of the second electrical connector 4 by printed circuit boards in ways disclosed in the U.S. Pat. No. 6,343,957 or wires in ways known to persons skilled in the pertinent art. The wires or the printed circuit boards are surrounded by an enclosure 30 of the connecting portion 3. The enclosure 30 is formed from metal. Alternatively, the enclosure 30 can also be formed from plastic and then surrounded by a copper foil. The shells 20, 40 and the metal or the copper foil of the enclosure 30 can cooperatively prevent the terminals 24, 44 and the printed circuit boards or wires from extraneous Electro-Magnetic Interference.

Figure 4:
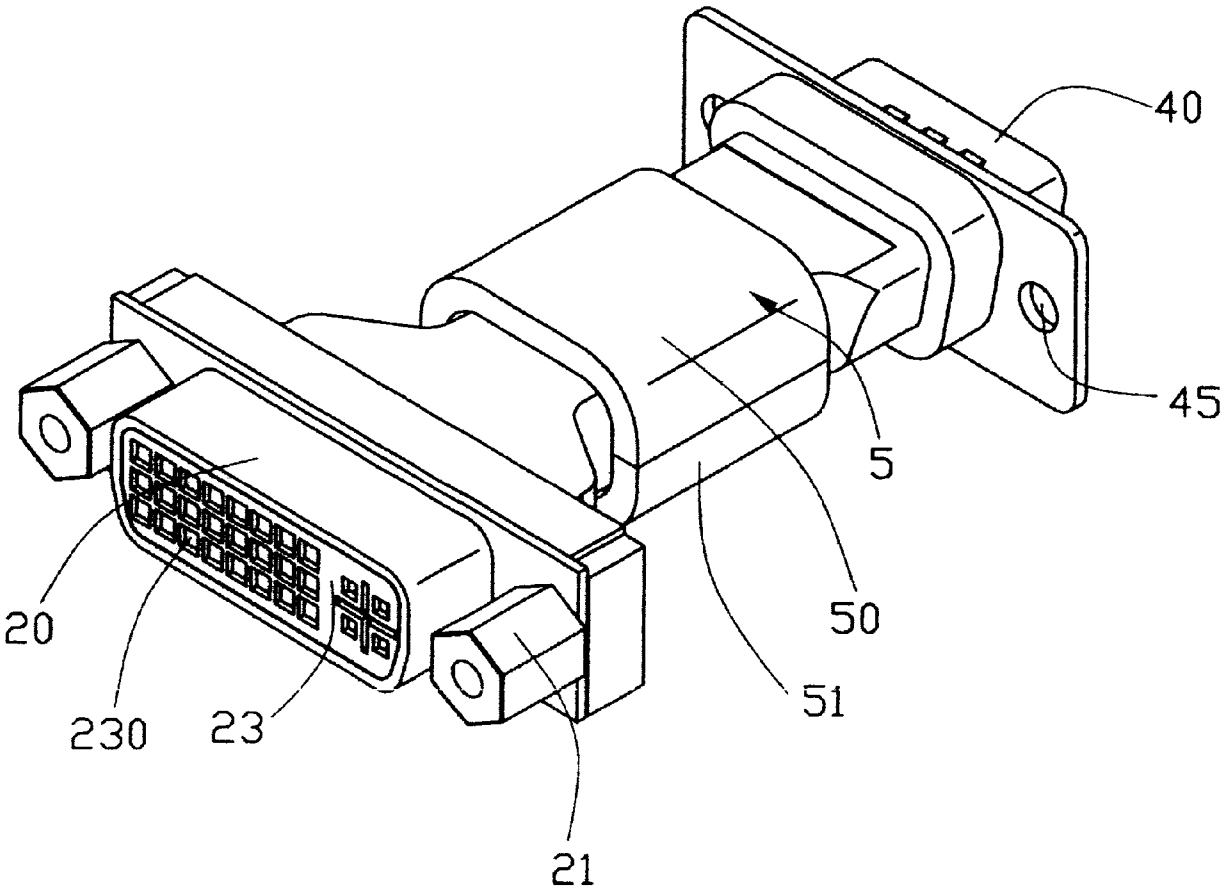
FIG. 4 is an assembled perspective view of FIG. 3.

Further referring to FIG. 4, the noise absorber 5 comprises two hemi-loop-shaped ferrite members 50, 51. The two magnetic ferrite members 50, 51 form a closed loop for clamping the connecting portion 3. Since the noise absorber 5 is positioned between the two electrical connectors 2, 4, the electromagnetic noise accompanying the signal transmitted in the printed circuit boards or the wires can be absorbed effectively by the ferrite members 50, 51 of the noise absorber 5. Thus, the quality of the signal transmitted between related electrical devices can be significantly improved. Finally, the cover 6 is formed integrally outside the noise absorber 5, the connecting portion 3 and rear portions of the two electrical connectors 2, 4. Alternatively, the cover 6 can also be assembled to the electrical connectors 2, 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

a first electrical connector comprising a first insulative housing and a plurality of first terminals received in the first housing;

a second electrical connector comprising a second insulative housing and a plurality of second terminals received in the second housing;

a connecting portion electrically connecting the first electrical connector and the second electrical connector; and a noise absorber disposed on the connecting portion for absorbing electromagnetic noise;

wherein the first electrical connector comprises a metallic shell attached to the first housing;

wherein the second connector comprises a metallic shell attached to the second housing;

wherein the noise absorber comprises two hemi-loop shaped ferrite members;

wherein the two ferrite members form a closed loop clamping the connecting portion;

further comprising a cover surrounding the connecting portion and the noise absorber.

2. The electrical adapter as claimed in claim 1, wherein the first terminals of the first connector are electrically connected with the second terminals of the second connector by printed circuit boards.

3. The electrical adapter as claimed in claim 2, wherein the connecting portion comprises an enclosure formed from metal and surrounding the printed circuit boards.

4. The electrical adapter as claimed in claim 1, wherein the first terminals of the first connector are electrically connected with the second terminals of the second connector by wires.

5. The electrical adapter as claimed in claim 4, wherein the wires are surrounded by an enclosure formed from plastic, the enclosure being surrounded by a copper foil.

6. An electrical adapter comprising:

a first electrical connector comprising a first metallic shell;

a second electrical connector opposite to the first connector and comprising a second metallic shell;

a connecting portion located between and electrically connecting the first and the second connectors; and a noise absorber disposed on the connecting portion for absorbing the electromagnetic noise;

wherein the noise absorber comprises two hemi-loop shaped ferrite members;

wherein the two ferrite members form a closed loop clamping the connecting portion;

further comprising a cover surrounding the connecting portion and the noise absorber.

7. An electrical connector assembly comprising:

first and second connectors located on two opposite ends of an elongated connection portion along a front-to-back direction with respective mating ports facing outwardly and oppositely;

the connection portion being dimensioned to be smaller than those of said first and second connectors in a transverse direction perpendicular to said front-to-back direction;

a noise suppressing device surrounding said connection portion; and over-molded insulation applied unto the first and second connectors, the connection portion and the noise suppressing device so as not to expose said noise suppressing device to an exterior;

wherein a pair of spaces are formed by two sides of the connection portion and the associated noise suppressing device, and a pair of screws are located in said pair of spaces, respectively.

* * * * *